US005163625A

United States Patent [19]

Takayama et al.

[11] Patent Number: 5,163,625

[45] Date of Patent: Nov. 17, 1992

[54] ELECTROSTATIC COATING MACHINE

[75] Inventors: Shinichi Takayama, Chigasaki; Yoshihisa Tsuboi, Yokohama, both of Japan

[73] Assignee: Ransburg Automotive KK, Tokyo, Japan

[21] Appl. No.: 775,927

[22] PCT Filed: May 17, 1991

[86] PCT No.: PCT/JP91/00654

§ 371 Date: Nov. 6, 1991

§ 102(e) Date: Nov. 6, 1991

[87] PCT Pub. No.: WO91/17836

PCT Pub. Date: Nov. 28, 1991

[30] Foreign Application Priority Data

May 18, 1990 [JP] Japan ..... 2-128702
Feb. 21, 1991 [JP] Japan ..... 3-48907

[51] Int. Cl.[5] ..... B05B 5/04; B05B 5/08; B05D 1/04

[52] U.S. Cl. ..... 239/703; 239/690

[58] Field of Search ..... 239/690, 691, 699-703, 239/706, 707

[56] References Cited

U.S. PATENT DOCUMENTS

| | | | |
|---|---|---|---|
| 3,393,662 | 7/1968 | Blackwell | 239/706 |
| 4,771,949 | 9/1988 | Behr et al. | 239/703 |
| 4,872,616 | 10/1989 | Behr et al. | 239/703 |
| 5,011,086 | 4/1991 | Sonnleitner et al. | 239/691 |
| 5,039,019 | 8/1991 | Weinstein et al. | 239/691 |

FOREIGN PATENT DOCUMENTS

| | | |
|---|---|---|
| 63-258665 | 10/1988 | Japan . |
| 2-37765 | 3/1990 | Japan . |

*Primary Examiner*—Andres Kashnikow
*Assistant Examiner*—Karen B. Merritt
*Attorney, Agent, or Firm*—Oblon, Spivak, McClelland, Maier & Neustadt

[57] ABSTRACT

Described herein is an electrostatic spray coating machine of the type which has a plural number of supporters (31) at intervals around the circumference of a housing (2) as electrode retainer rods for holding external electrodes (32). Each supporter (31) is formed with an oblique surface (31A) at the fore end thereof to provide a concealing projection (31B) on the inner side of the fore end of the supporter (31). As a result, when seen from the rotary atomizer head (5), the discharge distance (H') betweewn the fore end (32A) of each external electrode (32) and the rotary atomizer head (5) is increased to permit application of a higher voltage to the external electrodes (32).

2 Claims, 7 Drawing Sheets

ELECTROSTATIC COATING MACHINE

FIELD OF THE ART

This invention relates to an electrostatic spray coating machine with a rotary atomizer head, and more particularly to an electrostatic spray coating machine suitable for spraying aqueous and metallic type paints.

BACKGROUND OF THE ART

Generally, the paints designed for electrostatic spray coating are classified into a solvent type paint (an oil paint) which has a relatively large electric resistance, an aqueous type paint (a water paint) which has a relatively small electric resistance, and a metallic type paint with a dispersed metal powder content has a relatively small electric resistance similarly to the aqueous paint. Since the electric resistance of the paint varies depending upon the type or nature of the paint in this manner, it is the usual practice to apply high voltage by a different method for a different type of paint.

More specifically, the component parts such as paint tank and color changing valve are connected to the earth in operation from the standpoint of preventing danger. In this regard, in case of a solvent type paint with a relatively large electric resistance, there is no possibility of the rotary atomizer head being shorted to the earth potential through a paint supply conduit even if a high voltage is directly applied to the rotary atomizer head. Accordingly, the electrostatic spray coating machine for the solvent type paint is generally arranged to apply a high voltage directly to a rotary atomizer head for direct charging of paint particles.

On the other hand, in case of the aqueous type paint or metallic paint which has a small electric resistance, direct application of high voltage to a rotary atomizer head will invite the problem of shortcircuiting of the rotary atomizer head to the earth potential through the paint in the paint feed conduit, failing to charge the paint particles. Therefore, in case of an aqueous paint, it is the usual practice to apply a high voltage to external electrodes which are located in positions radially outward of a rotary atomizer head, forming a corona discharge region forward of the rotary atomizer head thereby to indirectly charge the sprayed paint particles from the atomizer head.

Illustrated in FIGS. 6 to 9 is an electrostatic coating machine of a prior art construction employing the indirect charging system for the aqueous paint.

In these figures, indicated at 1 is a coating machine of the rotary atomizer head type, which is largely constituted by a cylindrical housing 2 formed of a synthetic resin material (e.g., polytetrafluoroethylene), an air motor 3 mounted within the housing 2 and internally provided with an air bearing (not shown), a rotational shaft 4 rotationally driven from the air motor 3, a rotary atomizer head 5 mounted on the rotational shaft 4 on the front side of the housing 2, and a paint feed tube 6 in the form of a metal pipe passed through the rotational shaft 4 to supply paint to the rotary atomizer head 5. An insulate support 7 is projected on the rear side of the housing 2, the insulate support 7 being mounted on a reciprocator or the like. The basic construction of the air motor 3 is known from Applicant's prior application, Laid-Open Japanese Utility Model Application 60-13259, and therefore its detailed description is omitted here.

The reference numeral 8 denotes an annular electrodemounting bracket which is located radially on the outer side of the circumference of the housing 2 and radially outward of the rotary atomizer head. The bracket 8 is supported on the rear end of the housing 2 through support arms 8A. Indicated at 9 are supporters which are formed of a plastic material (e.g., polytetrafluoroethylene) to serve as electrode retainer rods which cover external electrodes 10 as will be described later. Each supporter 9 is provided with a recess 9A at its fore end, and six of this sort of supporters 9 are provided in equidistant positions around the circumference of the electrode brackets 8. As shown in FIG. 9, the external electrodes 10 are axially fitted and retained in the respective supporters 9, in such a way that the fore end 10A of each external electrode 10 is protruded out of the recess into a position flush with the fore end face of the supporter 9. Further, the fore end 10A of each external electrode 10 is located slightly rearward and radially outward of the rotary atomizer head 5.

Designated at 11 is a paint supply source, which is constituted by a motor 12, a paint pump 13, a paint tank 14 and so forth, storing an aqueous paint in the paint tank 14. The paint supply source 11 as a whole is connected to the earth 15.

Indicated at 16 is a pneumatically driven three-way change-over valve which is mounted on the insulate support 7, the inlet port of the three-way change-over valve 16 being connected to the paint pump 13 through a paint feed conduit 17 while the outlet port of the valve is connected to the feed tube 6 through a spiral hose 18 covered with a synthetic resin material. Further, the return port of the valve is opened into the paint tank 14 through a return conduit 19. The three-way change-over valve 16 normally communicates the paint feed conduit 17 with the return conduit 19 to relief the paint, and, when switched to an operating position, communicates the paint feed conduit 17 with the spiral hose 18 to supply the paint to the rotary atomizer head 5.

The reference 20 denotes a high voltage generator which is constituted, for example, by a Cockcroft circuit or the like, and electrically connected to the external electrodes 10 through a high voltage cable 21 to apply thereto a high voltage of $-50 \sim -90$ kV. For this purpose, the fore end of the high voltage cable 21 is connected to the electrode bracket 8.

For coating a workpiece 22 by the use of the electrostatic spray coating machine of the construction as described above, the air motor 3 of the coating machine 1 is put in high speed rotation to drive the rotational shaft 4 and the rotary atomizer head 5 at a speed of $40{,}000 \sim 60{,}000$ rpm. Concurrently, a high voltage is applied to the respective external electrodes 10 from the high voltage generator 20 through the cable 21 thereby forming a corona discharge region forward of the fore end 10A of the external electrodes 10. Further, the paint supply source 11 is actuated, but the aqueous paint is relieved through the three-way change-over valve 16. In this state, upon switching the three-way change-over valve 16 to the feed position, the aqueous paint in the tank 14 is fed to the rotary atomizer head 5 through the paint pump 13, paint feed conduit 17, three-way change-over valve 16, spiral hose 18 and feed tube 6. The paint is atomized by the rotary atomizer head 5 into micro particles, which are charged as they are passed through the corona region and caused to fly along the electrostatic field between the external electrodes 10 and the workpiece 22 for deposition on the latter.

In case of the above-described prior art electrostatic spray coating machine employing external electrodes, an aqueous paint is atomized by the high speed rotation of the rotary atomizer head 5 and sprayed in radial directions under the influence of centrifugal force. At this time, with aqueous paint, which uses water as a dispersant or diluent, the water content in the sprayed paint evaporates to increase the water density in the space between the rotary atomizer head 5 and the external electrodes 10. On the other hand, since a high voltage is applied to the external electrodes 10, the resulting water vapors are charged upon elevating the high voltage, increasing the value of current flow between the external electrodes 10 and the rotary atomizer head 5 to such a degree as to bring about the discharge phenomenon.

As a result of such a discharge phenomenon, the high voltage applied to the respective external electrodes 10 is shortcircuited to the earth 15, from the rotary atomizer head 5 through the feed tube 6, spiral hose 18 and three-way change-over valve 16. In order to prevent the discharge phenomenon of this sort, it is necessary to control the high voltage to be applied to the respective external electrodes 10, according to a maximum voltage VMAX which is automatically determined. For example, in a case where the distance (hereinafter referred to as "distance H") between each external electrode 10 and the rotary atomizer head 5 is 100 mm, the maximum voltage VMAX which can be applied to the external electrodes 10 free of the discharge phenomenon is predetermined to be in the range of $-54 \sim -57$ kV, limiting the efficiency of paint deposition on the workpiece 22 to about $70 \sim 80\%$.

It has been known in the art that the deposition efficiency can be enhanced by increasing the voltage to be applied to the respective external electrodes 10. However, the prior art has a problem in that the paint deposition is rendered infeasible by the discharge phenomenon which takes place between the rotary atomizer head 5 and external electrodes 10, when a voltage in excess of the above-mentioned maximum voltage VMAX is applied to the external electrodes 10.

In order to solve this problem, it may be conceivable to increase the distance H of the external electrodes 10 from the rotary atomizer head 5. However, in such a case, although the maximum voltage VMAX can be increased, there will arise another problem that the number of the external electrodes 10 has to be increased because six external electrodes are not sufficient to make up for the reduction in density of the paint particles to be charged in the corona discharge region formed forward of the respective external electrodes 10. A further increase of the distance H will result in a lower velocity of the sprayed paint particles in the corona discharge regions, the sprayed paint particles being influenced by the static attractive force to a greater degree correspondingly to the reduction in velocity of the sprayed paint particles and attracted toward the external electrodes 10. Consequently, the external electrodes 10 are contaminated by paint deposition. Therefore, the external electrodes 10 should be located in positions where the distribution density and velocity of the sprayed paint particles are high enough to permit effective charging by a minimum number of electrodes.

Namely, since the initial velocity F of the sprayed paint from the rotary atomizer head and the static attractive force f in the corona discharge region are in the relationship of $$\frac{F}{f} \geqq 1 \qquad (1)$$

it is advantageous to locate the respective external electrodes 10 at a distance H within a range which satisfies Equation (1) above, in order to charge the paint particles effectively by the use of a minimum number of external electrodes. Accordingly, even if the maximum voltage VMAX could be elevated, the method of simply locating the respective external electrodes 10 at a greater distance from the rotary atomizer head 5 is not the best way of enhancing the deposition efficiency.

In view of the above-mentioned problems of the prior art, the present invention has as its object the provision of an electrostatic coating machine with an external electrode system, which permits to elevate the high voltage to be applied to the external electrodes for enhancing the paint deposition efficiency without giving rise to the discharge phenomenon even in case of an aqueous or metallic paint.

DISCLOSURE OF THE INVENTION

In order to solve the above-mentioned problems, the present invention employs a construction which is characterized by the provision of electrode retainer rods each being formed with an oblique surface at the fore end thereof to have a greater length on the inner side facing toward a rotary atomizer head and a shorter length on the outer side.

With the above-described construction, when seen from the rotary atomizer head, each external electrode is concealed behind a projected end of the oblique surface of the electrode retainer rod in such a manner as to increase the apparent distance between the external electrode and the rotary atomizer head, permitting to elevate the high voltage to be applied to the external electrodes for attaining a higher paint deposition efficiency while suppressing occurrence of the discharge phenomenon.

BEST MODE FOR CARRYING OUT THE INVENTION

Figure 1:
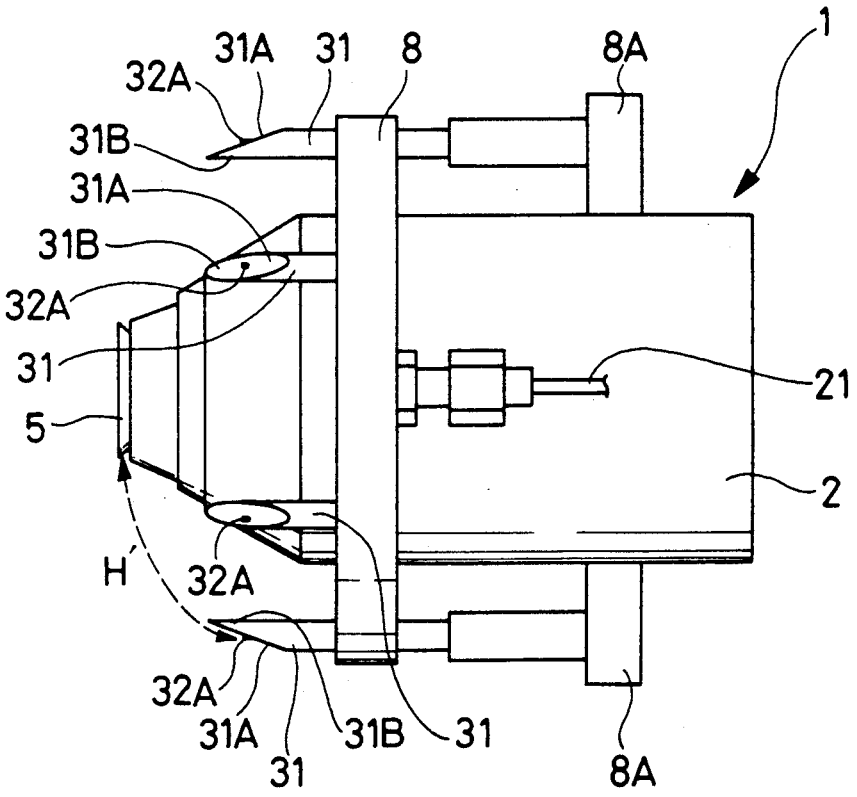
FIG. 1 is a side view of a spray coating machine in a first preferred embodiment according to the invention.

Hereafter, the invention is described by way of preferred embodiments shown in FIGS. 1 through 5. In the following description, the component parts common with the above-described prior art are designated by common reference numerals, and their descriptions are omitted to avoid repetitions.

Figure 2:
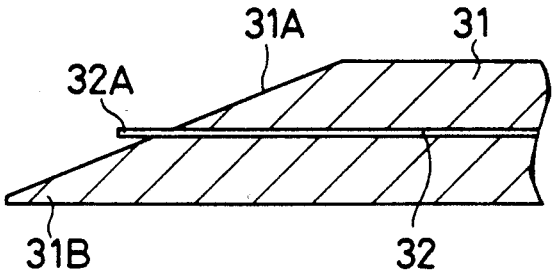
FIG. 2 is an enlarged fragmentary sectional view of an electrode retainer rod.

Referring first to FIGS. 1 and 2, there is shown a first embodiment of the invention.

Indicated at 31 are supporters which are employed as electrode retainer rods in this embodiment, each supporter 31 being formed of an insulating synthetic resin material (e.g., polytetrafluoroethylene) and, similarly to the afore-mentioned prior art supporter 9, mounted on an annular bracket 8 in a position slightly rearward and radially outward of the rotary atomizer head 5. In this instance, the fore end face of each supporter 31 is formed in an outwardly inclined oblique face 31A defining a concealing projection 31B on the inner side toward its distal end. Namely, when seen from the rotary atomizer head 5, each supporter 31 which forwardly terminates in the oblique end face 31A has a greater length on the inner side with the concealing projection 31B in face to face relation with the rotary atomizer head 5 and a shorter length on the outer side away from the rotary atomizer head 5.

Indicated at 32 are external electrodes which are axially embedded in the respective supporters 31, fore end 32A of each external electrode 32 being slightly protruded out of the oblique end face 31A of the supporter 31 in such a degree that it is concealed behind the projecting portion 31B of the oblique end face 31A and directly invisible from the rotary atomizer head 5. Each one of the external electrodes 32 is electrically connected to a high voltage generator 20 through a high voltage cable 21.

The present embodiment with the foregoing arrangements involves no particular differences from the prior art spray coating machine in the manner of operation.

In this embodiment, the fore end face of each supporter 31 is formed into an oblique surface 31A which contributes to prolong the distance H' between the external electrode 32 and the rotary atomizer head 5 by a length corresponding to the concealing projection 31B, as compared with the prior art counterpart, lowering the value of current flowing across the distance H' for suppression of the discharge phenomenon. On the other hand, the breadth of the corona region which is formed at the fore end 32A of each external electrode 32 is almost same as in the prior art counterpart, permitting to charge aqueous paint particles and to increase the current value between each external electrode and the workpiece 22. Further, the concealing projection 31B which is in the form of a sharp edge can maintain laminar flows without blocking the air streams produced by the rotary atomizer head 5.

Thus, in this embodiment, the respective external electrodes 10 are provided within a range which satisfies Equation (1) and, despite the respective external electrodes 10 are located in positions similar to those of the external electrodes 10 of the prior art, it becomes possible to increase the maximum value VMAX of the high voltage to be applied to the respective external electrodes 32 to about 120% ($-65 \sim -70$ kV) of the value in the prior art counterpart, enhancing the deposition efficiency by $5 \sim 10\%$.

Figure 3:
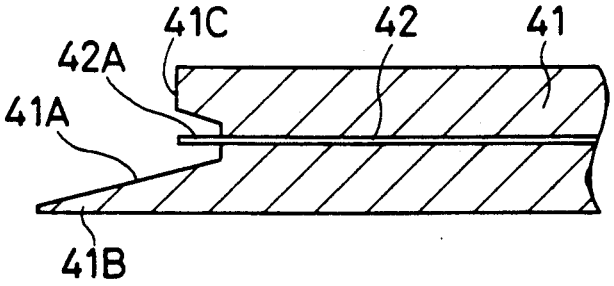
FIG. 3 is a view similar to FIG. 2 but showing a second preferred embodiment of the invention.

Referring now to FIG. 3, there is illustrated a second embodiment of the invention, a feature of which resides in that an oblique surface is provided only on half of the fore end face of the electrode retainer rod. In this case, the component parts common with the abovedescribed first embodiment are also designated by common reference numerals, and their descriptions are omitted to avoid repetitions.

In this figure, the reference 41 denotes a supporter which serves as one of the electrode retainer rods in this embodiment. The supporter 41 is formed of an insulating synthetic resin material (e.g., polytetrafuluoroethylene), and, similarly to the supporter 31 in the above-described first embodiment, mounted on an annular bracket 8 in a position slightly rearward and radially outward of the rotary atomizer head 5. However, in this embodiment, the supporter 41 is provided with an oblique surface 41A only on half of its fore end face on the inner side of its center axis or on the side of the rotary atomizer head 5, the oblique surface 41A forming a concealing projection 41B toward its fore end on the inner peripheral side. A flat surface 41C is provided on the outer side away from the rotary atomizer head 5. Denoted at 42 is an external electrode which is axially embedded in the supporter 41. The fore end 42A of the external electrode 42 is slightly protruded from the center of the supporter 41 to such a degree that the fore end portion 42A is hidden behind the concealing projection 41B and directly invisible from the rotary atomizer 5. The external electrode 42 is electrically connected to a high voltage generator 20 through a high voltage cable 21.

The electrostatic spray coating machine of this arrangement has the same operational effects as the abovedescribed first embodiment.

Thus, by shaping the supporters 41 as in the present embodiment, the distance H' can be maintained between the rotary atomizer head 5 and each external electrode 42, thereby permitting to increase the value of the maximum voltage VMAX to be applied to the external electrodes 42 for enhancement of the deposition efficiency in the same manner as in the first embodiment.

Figure 4:
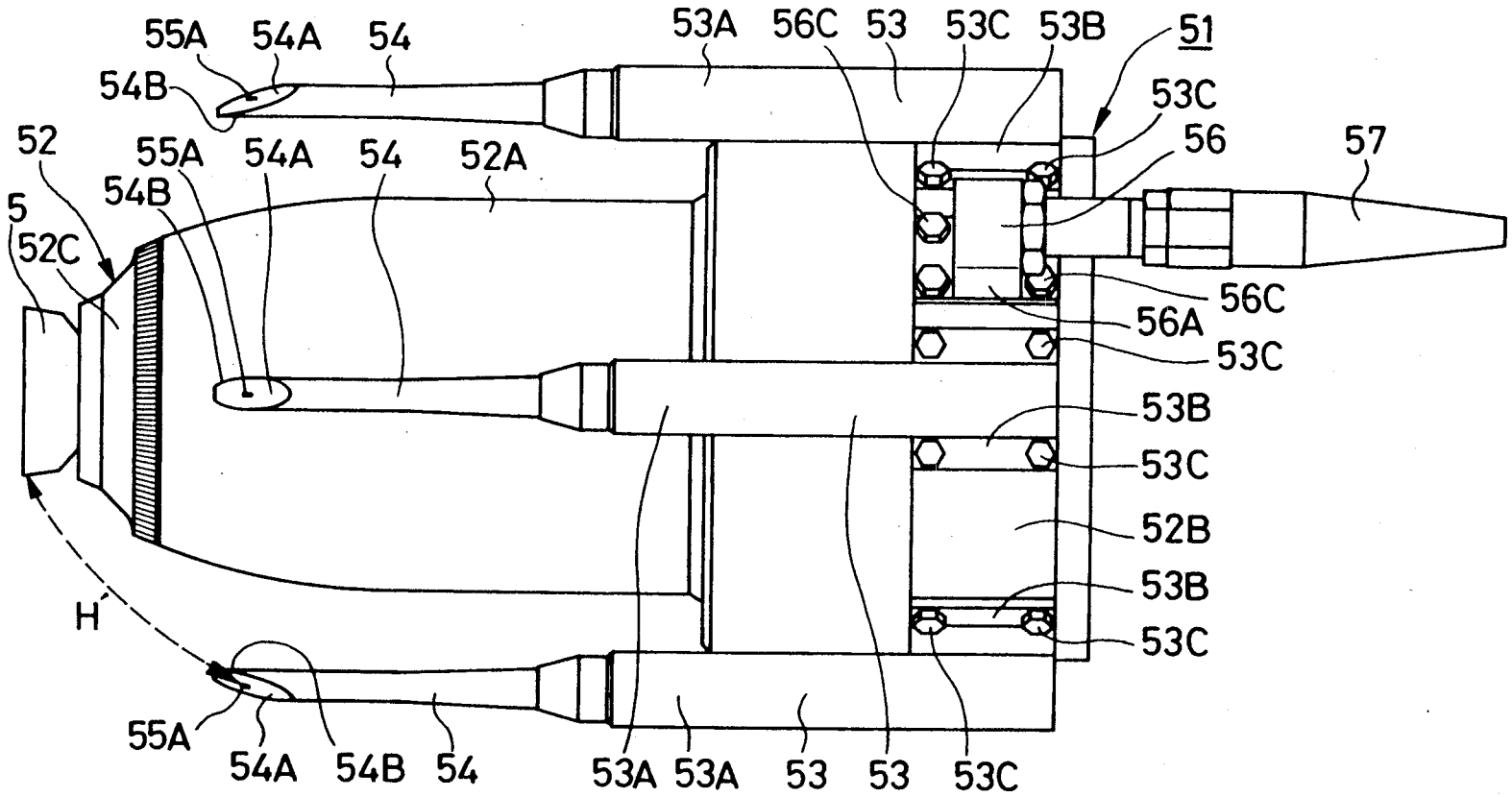
FIG. 4 is a side view of a spray coating machine in a third preferred embodiment of the invention.
Figure 5:
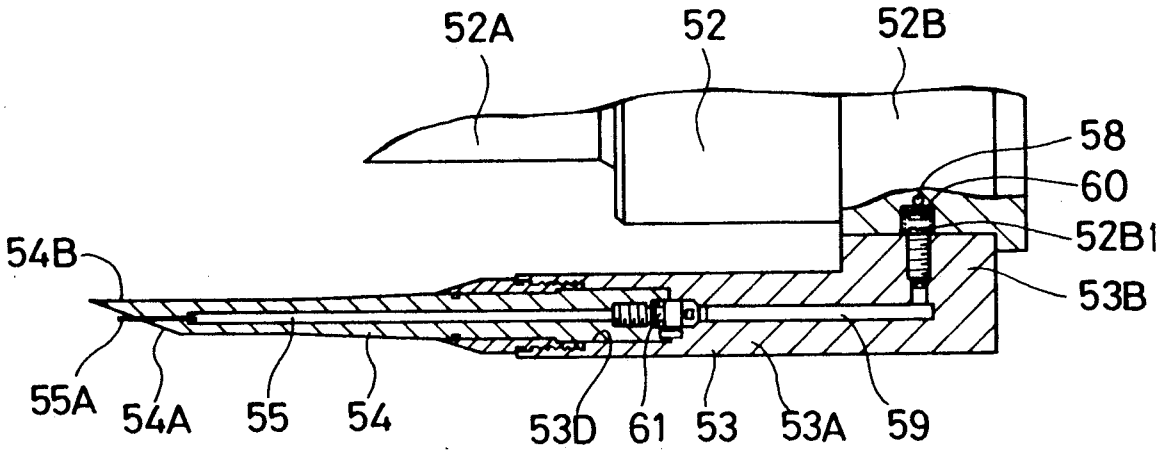
FIG. 5 is a sectional view of an L-shaped arm, an electrode retainer rod and an external electrode shown in FIG. 4.
Figure 6:
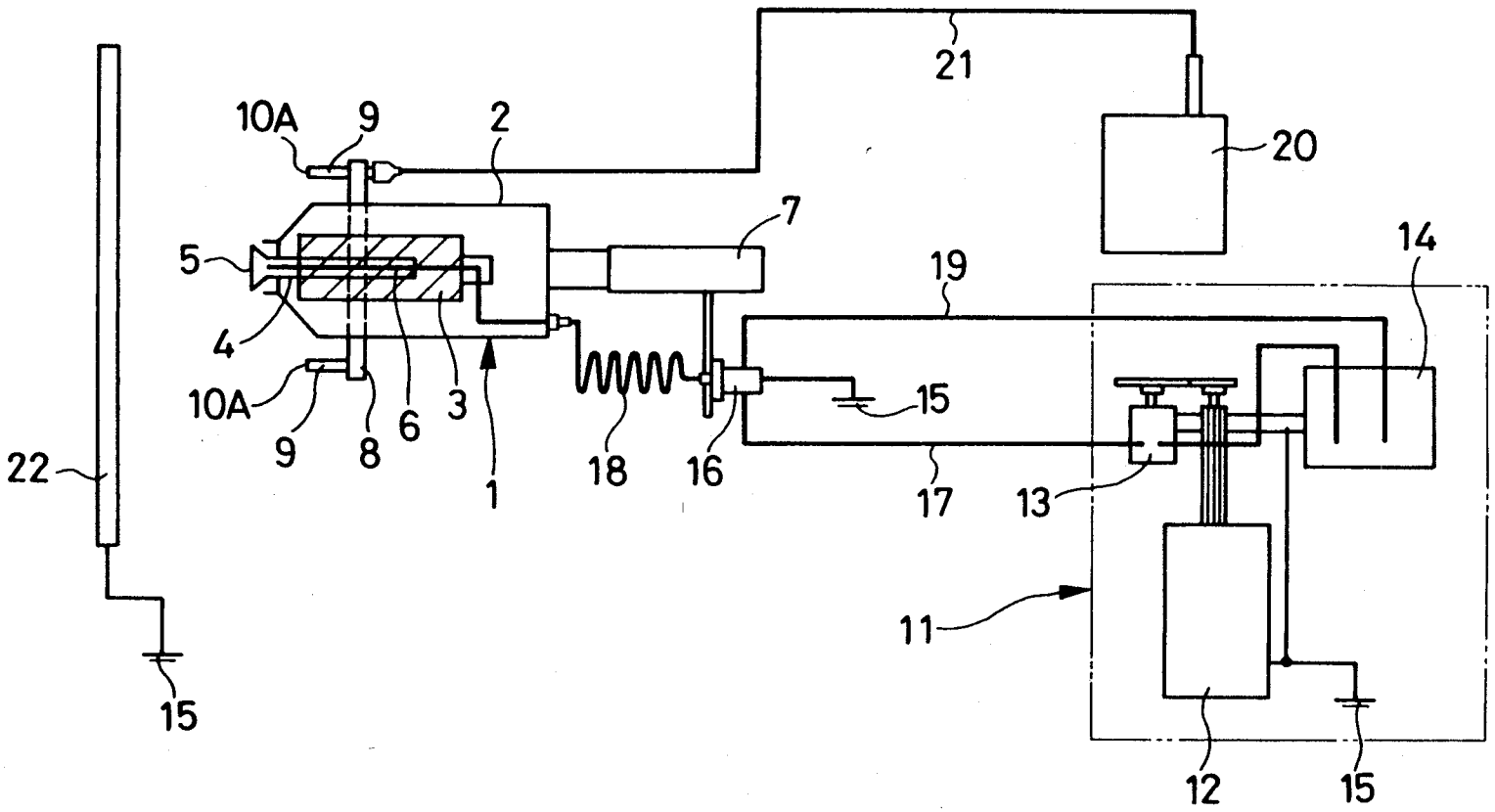
Fig. 6 PRIOR ART
FIG. 6 is a schematic view of a prior art electrostatic coating machine, showing its general arrangement.
Figure 7:
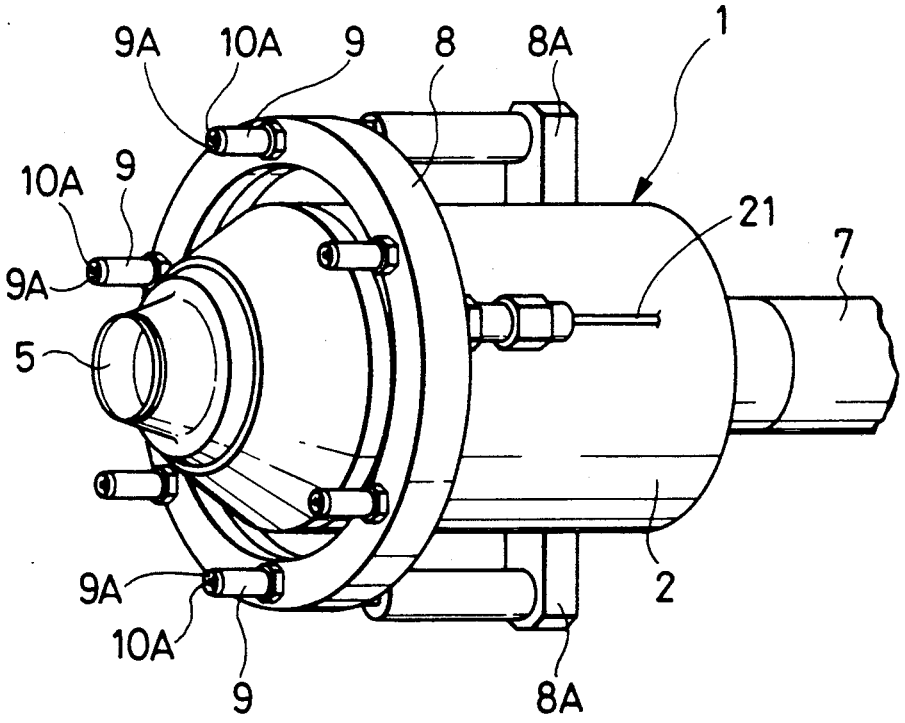
Fig. 7 PRIOR ART
FIG. 7 shows in a perspective outer view a prior art coating machine head assembly as a specific example.
Figure 8:
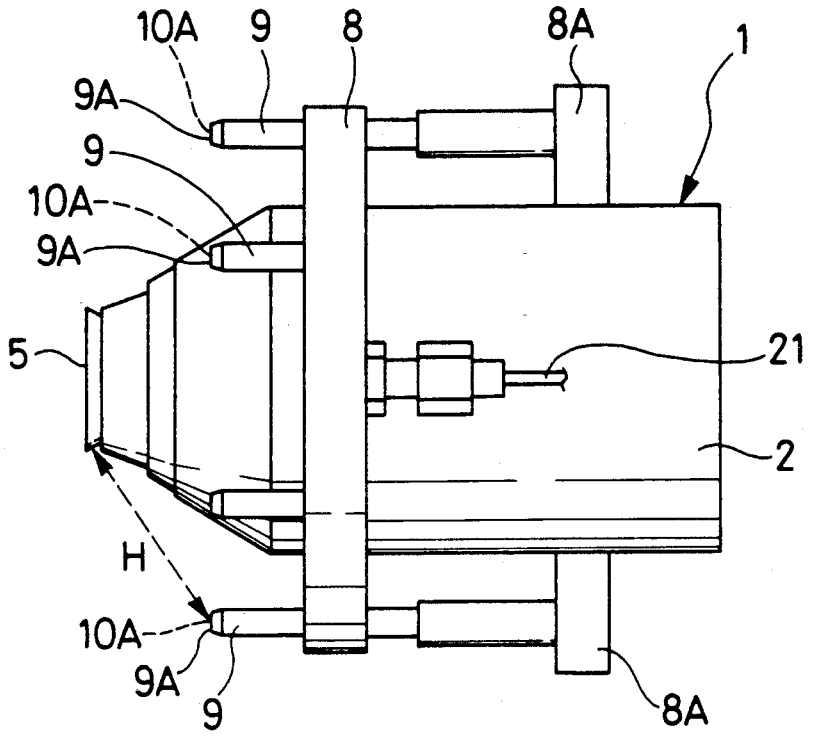
Fig. 8 PRIOR ART
FIG. 8 is a side view of the coating machine head of FIG. 7.
Figure 9:
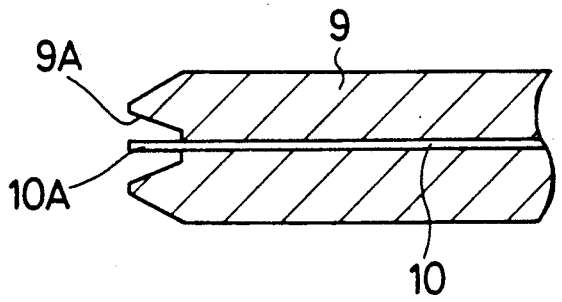
Fig. 9 PRIOR ART
FIG. 9 is an enlarged fragmentary sectional view of an electrode retainer rod shown in FIG. 8.

Referring to FIGS. 4 and 5, there is shown a third embodiment of the invention, a feature of which resides in that the respective electrode supporters are mounted in position by means of a plural number of electrode support arms which are fixed on the rear end of the housing, in place of the annular bracket of the first embodiment. The component parts common with the above-mentioned prior art counterpart are designated by common reference numerals and their descriptions are omitted to avoid repetitions.

In these figures, the reference 51 indicates another embodiment of the rotary atomizer head type coating machine, which is largely constituted by a housing 52 forming a main body of the spray coating machine 51 as will be described later, a rotary atomizer head 5 projected from a shaping ring 52C of the housing 52 and mounted on an air motor 3 in the housing 52 for rotation in synchronism with a rotational shaft 4, and a paint feed tube (not shown) in the form of a metal tube passed through the rotational shaft 4 to supply paint to the rotary atomizer head 5. However, this embodiment differs from the foregoing embodiments in that six supporters 54 are located in uniformly spaced positions around the outer periphery of the housing 52 as electrode retainer rods, and six L-shaped arms 53 which will be described later are fixed around the rear end of the housing as electrode support arms for mounting the supporters 54.

Designated at 52 is a housing of the spray coating machine 51, which is formed into a stepped cylindrical shape by the use of an insulating synthetic resin material (e.g., polytetrafluoroethylene), and which is largely composed of a fore cylindrical body 52A, a rear cylindrical body 52B provided behind and formed in a larger diameter than the fore cylindrical body 52A, and a shaping ring 52C provided on the front side of the fore cylindrical body 52A. The rear cylindrical body 52B is provided with six connection holes 52BI in uniformly spaced positions around and on its circumferential surface for mounting L-shaped arms 53 (only one arm is shown in the drawing), which will be described later, along with connection holes (not shown) for mounting high voltage connection members 56 which will also be described hereinlater.

Indicated at 53 are six L-shaped electrode-mounting arms of an insulating synthetic resin material, which are provided in positions corresponding to the connection holes 52BI on the rear body 52B of the housing 52. Each L-shaped arm 53 is extended toward the fore end of the housing 52 axially in parallel relation therewith, and provided with a cylindrically shaped retainer portion 53A for holding thereon a supporter 54 which will be described later, and a rectangular base portion 53B fixed on the rear body 52B of the housing 52 in the radial direction. The fixed base portion 53B is secured to the rear body 52B of the housing 52 by screws 53C. The retainer portion 53A has a receptacle hole 53D axially bored in its fore end portion to fit the supporter 54 therein.

The reference 54 indicates supporters which are formed of an insulating synthetic resin material and which are employed in the present embodiment as electrode retainer rods to be fitted in the receptacle holes 53D in the L-shaped arms 53. Similarly to the supporters 31 of the first embodiment, each one of the supporters 54 is provided with an outwardly inclined oblique surface 54A on its fore end face to form a concealing projection 54B toward the fore end of the supporter 54 on the inner side thereof. Namely, due to the provision of the oblique surface 54B at the fore end of each supporter 54, the supporter 54 has a greater length on its inner side with the concealing projection 54B in face to face relation with the rotary atomizer head 5, and a shorter length on its outer side away from the rotary atomizer head 5, when viewed from the latter.

Designated at 55 are external electrodes which are axially embedded and retained in the respective supporters 54, tip end 55A of each external electrode 55 being slightly protruded out of the oblique surface of the supporter 54 in such a degree that the tip end 55A of the electrode 55 is directly invisible from the rotary atomizer head 5 and hidden behind the concealing projection 54B of the oblique surface 54A of the supporter 54. A corona discharge region is formed forward of the tip end 55A of each external electrode 55 upon applying a high voltage thereto.

Indicated at 56 is a high voltage coupling portion which is located in alignment with the connection holes on the rear body 52B of the housing 52. The high voltage coupling portion 56 is formed of a synthetic resin material in a rectangular shape having at one side thereof a fixing portion 56A and at the other side a receptacle hole (not shown) to receive therein a connector 57 at the fore end of the high voltage cable 21, which is located on a side wall away from the front side of the housing 52. The fixing portion 56A is secured to the rear body 52B of the housing 52 by screws 56C.

The reference 58 denotes an annular metal wire which is embedded in the rear body 52B of the housing 52, the annular metal wire 58 being formed in a circular shape larger in diameter than the front body 52A but smaller than the rear body 52B of the housing 52. The annular metal wire 58 is positioned in engagement with the respective connecting holes 52Bl which are formed in the rear body 52B.

Designated at 59 are metal wires (only one wire is shown in the drawing) which are axially embedded in the respective L-shaped arms 53. One end of each metal wire 59 is connected to the annular metal wire 58 through a connector member 60 including a contact plate and a spring formed of a conductive metal material, while the other end is connected to the external electrode 55 in the corresponding supporter 54 through a connector member 61.

With the rotary atomizer head type coating machine of the above construction, the high voltage which is supplied to the spray coating machine 51 from the high voltage generator 20 through the cable 21 is fed to the annular metal wire 58 in the housing 52 through the connector 57 and high voltage coupler 56, and from the annular conductor wire 58 to the metal wires 59 in the respective L-shaped arms 53 through the connector members 60 and then to the respective external electrodes 55 through the connector members 61. Consequently, the high voltage from the high voltage generator 20 is applied to the respective external electrodes 55 through the high voltage cable 21, forming a corona discharge region forward of the tip end 55A of each external electrode 55.

The electrostatic spray coating machine of this construction has the same operational effects as the first embodiment described above.

In the third embodiment, the supporters 54, each having the outwardly inclined oblique surface 54A on the fore end face thereof, are employed as electrode retainer rods to be mounted on the L-shaped arms 53. However, according to the present invention, these supporters may be replaced by the supporters 41 as in the second embodiment in which each supporter 41 is provided with an oblique surface 41A only on one side of its center axis, that is, on the inner side which confronts the rotary atomizer head 5, forming a concealing projection 41B toward the fore end of the oblique surface 41A, and a flat surface 41C on the outer side remote from the rotary atomizer head 5.

The supporter (electrode retainer rod) according to the invention is not restricted to the shapes of the supporters 31, 41 and 54 of the foregoing embodiments, and may be formed in other shapes as long as it has an oblique surface of an acute angle at its fore end in such a manner as to make the external electrode invisible directly from the rotary atomizer head 5 and to increase the distance H' thereby to securely maintain the corona discharge region formed by the external electrode.

Further, the present invention is not restricted to aqueous type paints and can also be suitably applied to metallic paints as well as to solvent type paints.

Moreover, according to the present invention, the electrode mounting bracket is not restricted to the shape of the bracket 8 or to the arrangement of the six L-shaped arms 53 shown in the foregoing embodiments, and may take other forms as long as it can hold the supporters 31, 41 or 54 in positions radially outward of the rotary atomizer head 5.

Possibilities of Industrial Application

As discussed in detail in the foregoing description, the electrostatic spray coating machine according to the present invention employs an electrode retainer rod construction with an oblique surface at the fore end thereof to increase the rod length on the inner side facing toward the rotary atomizer head, as compared with the rod length on the outer side, in such a manner as to conceal the external electrode behind the oblique surface when viewed from the side of the rotary atomizer head, thereby increasing the distance from the rotary atomizer head to the external electrode to reduce the value of current flow from the external electrode to the rotary atomizer head, and consequently permitting elevation of the maximum voltage to be applied to the external electrode for the purpose of attaining a higher deposition efficiency.

What is claimed is:

1. An electrostatic spray coating machine, including a housing accommodating a motor for driving a rotational shaft, a rotary atomizer head mounted on said rotational shaft on the front side of said housing and adapted to be rotationally driven from said motor, a paint supply source located in a position away from said rotary atomizer head, a paint feed passage communicating said paint supply source with said rotary atomizer head to supply a paint to the latter, an electrode mounting bracket attached to said housing in a position radially outward of said rotary atomizer head, a plural number of electrode retainer rods each formed of a synthetic resin material in a rod-like shape and mounted on said bracket, a plural number of external electrodes supported in the respective electrode retainer rods, and a high voltage generator connected to each one of said external electrodes through a high voltage cable to supply a high voltage to the respective external electrodes, characterized in that each one of said electrode retainer rods is formed with an oblique surface at the fore end thereof to have a greater length on the inner side facing toward said rotary atomizer head and a shorter length on the outer side.

2. An electrostatic spray coating machine, including a housing accommodating a motor for driving a rotational shaft, a rotary atomizer head mounted on said rotational shaft on the front side of said housing and adapted to be rotationally driven from said motor, a paint supply source located in a position away from said rotary atomizer head, a paint feed passage communicating said paint supply source with said rotary atomizer head to supply a paint to the latter, a plural number of electrode mounting arms each being secured at the base end thereof to a rear end portion of said housing and having the fore end thereof extended toward said rotary atomizer head, a plural number of electrode retainer rods each formed of a synthetic resin material in a rod-like shape and mounted on one of said electrode mounting arms, a plural number of external electrodes supported in the respective electrode retainer rods, and a high voltage generator connected to each one of said external electrodes through a high voltage cable to supply a high voltage to the respective external electrodes, characterized in that each one of said electrode retainer rods is formed with an oblique surface at the fore end thereof to have a greater length on the inner side facing toward said rotary atomizer head and a shorter length on the outer side.

* * * * *